US005109578A

United States Patent [19]

Cox

[11] Patent Number: 5,109,578

[45] Date of Patent: May 5, 1992

[54] GOLF CLUB COVER RETENTION APPARATUS

[76] Inventor: Carolee M. Cox, 7032 Montrose Rd., Woodbury, Minn. 55125

[21] Appl. No.: 783,556

[22] Filed: Oct. 28, 1991

Related U.S. Application Data

[63] Continuation of Ser. No. 602,404, Oct. 22, 1990, abandoned.

[51] Int. Cl.[5] ..... A44B 21/00

[52] U.S. Cl. ..... 24/298

[58] Field of Search ..... 24/300-302, 24/344, 345, 298, 115 H, 115 G, 265 H: 206/315.4, 315.6; 150/160; 273/32 R

[56] References Cited

U.S. PATENT DOCUMENTS

| | | | |
|---|---|---|---|
| 191,423 | 5/1877 | Hall | 24/265 H X |
| 330,319 | 11/1885 | Gurney | 24/115 H |
| 1,637,003 | 7/1927 | Lang | 24/115 G |
| 1,957,577 | 5/1934 | Chapman | 150/160 |
| 2,800,696 | 7/1957 | Aicher | 24/300 |
| 3,039,159 | 6/1962 | Burke | 24/298 |
| 3,460,207 | 8/1969 | Stewart | 150/160 X |
| 3,657,774 | 4/1972 | Reynolds | 24/298 |
| 4,126,166 | 11/1978 | Hohenstein | 150/160 X |
| 4,432,121 | 2/1984 | Dupre | 24/300 X |

*Primary Examiner*—James R. Brittain

*Attorney, Agent, or Firm*—Jacobson and Johnson

[57] ABSTRACT

A hand-sized golf club cover retention apparatus or connector is disclosed. The apparatus comprises a connector body to which there is attached golf bag connector means, such as a side clip or snap, and a plurality of flexible cords. The cords include movable loop securement means, such as card locks, which define a loop therein. The size of the loop and its distance from the connector body are both adjustable by means of the loop securement means.

11 Claims, 1 Drawing Sheet

GOLF CLUB COVER RETENTION APPARATUS

This application is a continuation of application Ser. No. 602,404 filed Oct. 22, 1990, now abandoned.

TECHNICAL FIELD

This invention relates to golf club cover retention means or connector means. More specifically, this invention relates to means or apparatuses for securing or connecting golf club head covers or head protectors to golf bags. Yet more particularly, the present invention pertains to connectors or securement means which are intended to prevent loss or misplacement of golf club head covers or protectors.

BACKGROUND OF THE INVENTION

The problem of how to protect expensive golf club heads during the rigors of play has been around since the earliest days of golf. Especially since the utilization of high density wood and wood laminate golf club heads became common, the problem of how to maintain the beauty and technical performance of these golf clubs has been of great concern to golfers. More recently, exotic composite polymeric materials and especially metal and metal alloys have been used to make golf club heads and shafts. Despite changes in composition, the problem has remained the same. To prevent denting, scratching, or chipping of the golf club head(s), the golf club heads and shafts must be protected from colliding or hitting against each other in the golf bag while being transported and used during play.

One approach has been to use golf club head covers or golf club head protectors. One variety of such head covers slips over the individual golf club heads and prevents the clubs from contacting each other while the clubs are being carried between golf shots and when the clubs are being removed from or returned to the golf club bag. During play, the individual club head protector is removed when a particular club is to be used. After the shot is taken, the cover is replaced on the golf club head after the club is replaced in the golf bag. For maximum protection of the club heads, utilization of the head covers should be continuous. To assure continuity, however, the golfer must find it reasonably convenient to remove, store, and replace the head covers throughout round play. The head covers must meet these constraints whether the golf bag is carried manually or transported on a pull cart or a riding cart.

The problem is that head covers, while used by nearly all golfers, are considered by most to be a frustrating, necessary evil. When removed from the club heads, the covers are generally loose, separate entities which require special handling by the golfer before the golf shot can be taken. Typically, the head cover is laid on the bag, on the ground, on the bench, or on the golf cart. As a result, head covers are frequently lost or misplaced. Concern about this kind of loss of golf club head covers tends to detract from the strategy and enjoyment of play.

While various solutions have been offered, the problem of how to prevent, conveniently and inexpensively, the loss or misplacement of golf club head covers throughout a round of play remains largely unsolved.

PRIOR ART

U.S. Pat. No. 4,126,166 to George Hohenstein describes a securing apparatus for golf head covers. The Hohenstein apparatus is a strap which is attached to the upper periphery of a golf bag. The apparatus further includes a plurality of flexible members which are attached to the strap and, in turn, to the respective golf club head covers. Hohenstein strongly advocates the quasi permanent attachment of his apparatus to both the golf club head cover and the golf bag itself. Hohenstein also suggests that the golf bag itself be modified during manufacture to accommodate his apparatus.

U.S. Pat. No. 2,925,840 to Wilbur E. Hird discloses a golf club head protector with a means to secure golf tees (FIG. 1, designations 31, 32, and 33). The Hird apparatus is an integral golf club head hood having a plurality of compartments into which the golf club heads are placed.

U.S. Pat. No. 3,460,207 to Andy C. Stewart has a general description of a strap-like golf club head fastener which attaches to the ring provided on most golf club bags. The fastener of Stewart has specified transverse stiffness and longitudinal flexibility to permit a cover removed from a golf club head to fall by gravity to the exterior of the bag while at the same time preventing rotation about its longitudinal axis. The purpose for the longitudinal stiffness is to direct the heads of the woods 180 degrees away from the irons. The fastener of Stewart overcomes the problem perceived by Stewart that the woods continuously rotate to interfere with access to the irons.

U.S. Pat. Nos. 1,957,577 (Gordon Chapman), 3,015,351 (Harry R. Harris), and 2,532,195 (Monroe H. Rosenow et al.) describe golf club head protectors of various configurations. The Chapman apparatus is a golf bag hood apparatus which is securely anchored to the golf bag. Harris discloses a complicated retractile device for retrieval of the golf club head covers. Rosenow et al. disclose a golf club cover having an elastic strip along the interior of the open end of the cover to prevent the cover from being displaced from the golf club head.

None of the devices disclosed in the above patents, alone or in combination, disclose the present invention. Whether for reasons of expense, intricacy of design, difficulty of application or for other less apparent but troublesome reasons, it is not believed that any of the above are presently commercially available.

SUMMARY OF THE INVENTION

Briefly, in one aspect, the present invention is a detachable connector means or securement means for securing or retaining golf club head protectors or covers to a golf bag. The connector of this invention comprises a substantially hand-sized or pocket-sized, preferably elongate, connector body. One end of the preferred connector body is connected to a golf bag securement or attachment means. The connector body may be adjustably or fixedly attached to the attachment means. The other end of the preferred connector body is connected to or coupled with a plurality of flexible cords. The cords, by their connection with the connector body define distal ends and proximal ends with respect to the body. On the distal ends of the cords is a moveable loop securement means. The cords are engaged by the loop securement means so that a loop is defined in the cord. By virtue of the moveability of the loop securement means, the size of the loop and the length of the cord between the loop and the connector body are both adjustable. In a preferred practice of this invention, the connector body is rectangular with the cords stitched within the connector body and emanating from one end thereof. In another preferred practice, the golf bag securement means is a clip which is adapted to snap onto or attach to one of the loops or rings which are commonly located on the outer perimeter of a golf bag adjacent the bag's opening. In this practice, the loop securement means is a device sold under the trade designation of "Cord Lok". In a further practice of this invention, the connector body is flexible and of a small size and a convenient design. This permits the connector to adapt, easily, to various golf bag configurations and designs.

DETAILED DESCRIPTION OF THE INVENTION

Figure 1:
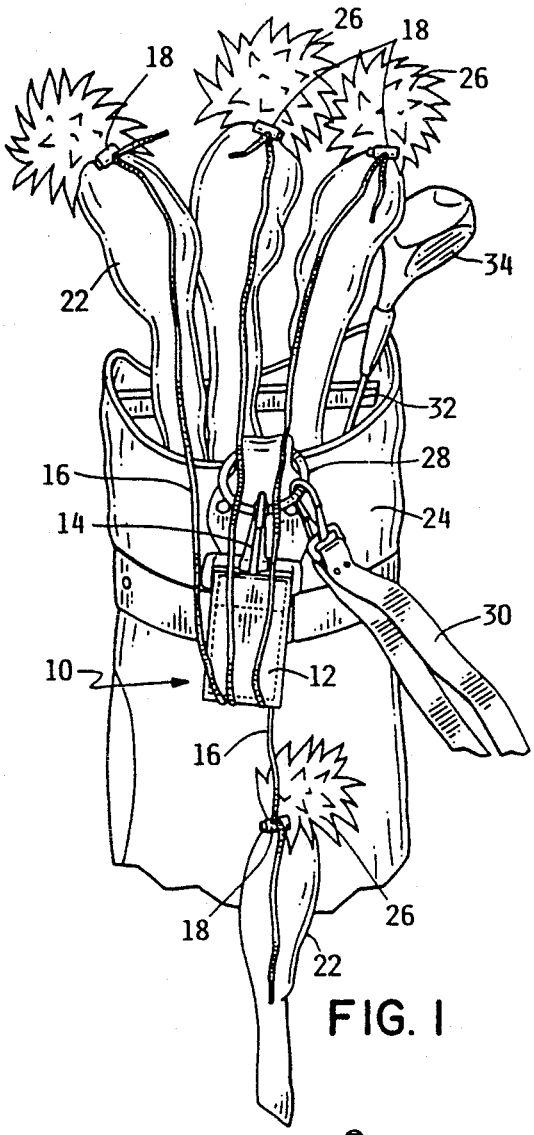
FIG. 1 is a perspective view of an apparatus of the present invention attached to the upper perimeter of a golf bag and to a plurality of golf club head covers.

There are shown in the attached Figures the details of one embodiment of the present invention. Like numerals are used to refer to like features of the invention in the various views. FIG. 1 is a perspective view of a connector of the present invention as it would appear when attached to the upper end of a golf bag and to a plurality of golf club head covers or protectors. Four golf club head covers would be a normal complement for most golfers. Securement means, retention means or connector 10 comprises a connector body 12 which is connected or coupled to a golf bag securement means. In the embodiment depicted, the securement means is a preferred side clip or snap 14. Clip 14 is coupled to or connected to, or attached to, one end of connector body 12. Connector body 12 on its opposite end is connected or coupled to a plurality of cords 16. Cords 16 are generally of the same length and will be of a number corresponding to the number of head covers that are to be retained. Cords 16 may be of various widths or thicknesses from about that of a shoe lace to considerably thicker. Cooperating with cords 16 on their end away from connector body 12 is a moveable loop securement means, e.g., a cord lock 18. The location of cord lock 18 is changeable throughout the entire length of cord 16. Moveover, cord 16 loops through cord lock 18 to create loop 20. The movability of cord lock 18 permits the length of cord 16 between connector body 12 and loop 20 to be adjusted. This feature also permits the size of loop 20 to be adjusted. In this manner the present invention may be used to secure golf club covers 22 to golf bag 24 at varying distances from the bag. Club covers 22 are of a particular variety, namely those having tassels 26. This invention is readily adaptable to club head covers having attachment points such as rings or loops as well as to those having tassels 26. In the latter case, the invention is particularly suitable since there is generally no other means (other than invasive sewing or tethering) to secure these covers to the golf bag. While rings, loops, or other attachment means could be sewn to the tassel-type head cover, this preferred invention's loop securement means accomplishes the same objective quickly and easily without such attachments.

Connector 10 is hooked to golf bag 24 by means of side clip 14 and a connector ring 28. Connector ring 28 is commonly placed on the outside upper portion of a golf bag to secure, for example, a shoulder strap 30.

Golf bag 24 is shown to be divided by divider 32. Divider 32 separates bag 24 into sectors for woods and irons. Wood 34 is shown just before it would be extracted from bag 24. Cover 22 is shown as it would appear when allowed to suspend from the connector while the golf shot is taken. By virtue of the adjustability of the cord length between loop 20 and connector body 12, the distance below the top of bag 24 the covers are permitted to swing may be shortened or lengthened.

Figure 2:
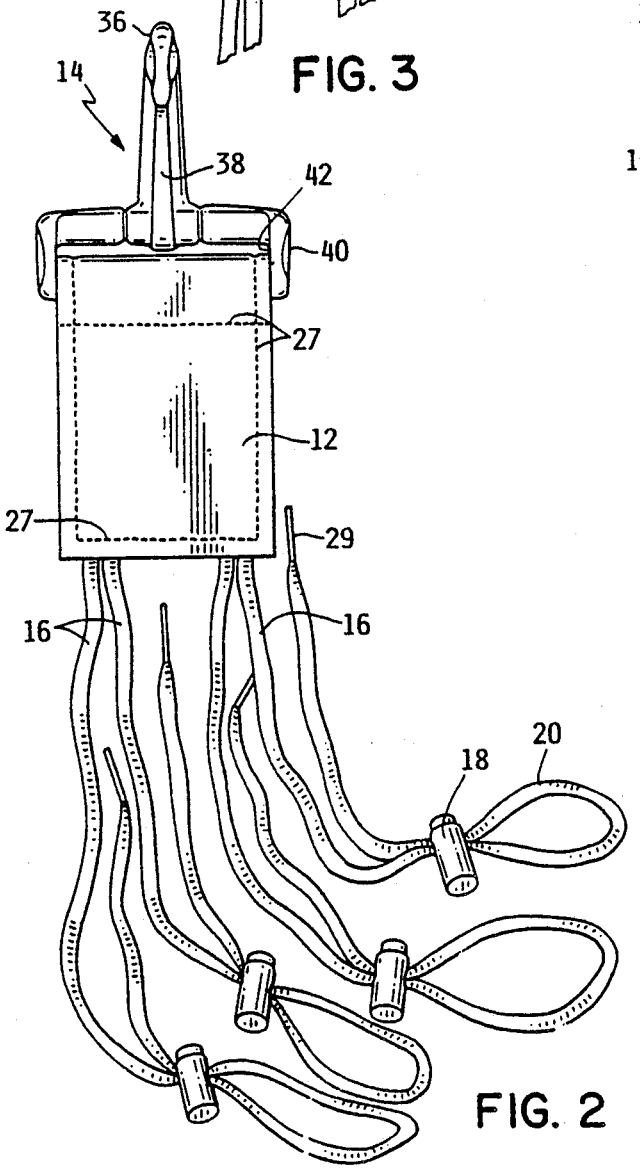
FIG. 2 is a detailed perspective view of a connector of the present invention.

FIG. 2 is a plan view of connector 10 shown attached to golf bag 24. Connector body 12 loops through opening 42 and the two portions are joined or stitched at stitching 27. Stitching or sewing 27 anchors or connects cords 16 within connector body 12 and also to side clip 14. While stitching or sewing are preferred means of connection, fabric adhesives, thermoplastic molding or other techniques may be employed to create connector body 10.

Connector body 12 may be comprised of pliable, non-pliable (i.e., rigid), artificial or natural materials. Vinyl, leather, Naugahyde fabric, plastic, nylon, or wood are specific candidate materials. The particular choice of material is largely determined by cost considerations, aesthetic considerations, the extent to which the connector body is to be flexible, and the desired durability of the completed article. Cords 16 are shown to have a terminus 29 on their distal ends. The terminus permits easy application and adjustment of loop securement means 18 (that is, insertion of the cord) as well as preventing raveling of the cord.

A particularly preferred moveable loop securement means or cord lock 18 is shown in FIG. 2. The cord locks themselves form no part of the invention but are believed to be described in U.S. Pat. Nos. 4,326,305 or 4,328,605 the teachings of which are incorporated by reference herein. The particular cord locks shown provide an opening through which the cord passes in two directions. The cord lock, by a spring mechanism, compresses the cord and holds it in a loop configuration. The movability of the cord lock permits both the size of the loop and the distance between the loop and the connector body to be adjusted. The mechanisms shown are believed to be commercially available from the Illinois Tool Works (ITW) Company. While the particular securement means shown are preferred, other moveable mechanisms, e.g., clips, or clamps, could be employed and are within the teaching of this invention.

Figure 3:
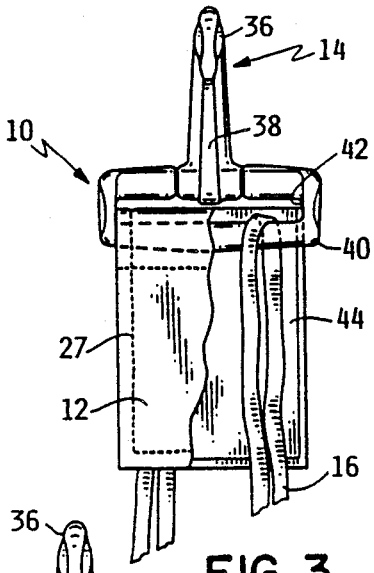
FIG. 3 is a perspective view of a connector of the present invention with parts broken away to show interior detail.

FIG. 3 is a detailed depiction of connector 10 with parts cut away to show its internal construction. Side clip 14 comprises a hook 36 and retainer 38. Retainer 38 is spring biased against the inside front of hook 36 so as to prevent hook 36 from being detached from the location on the golf bag to which it is attached. Retainer 38 is depressed away from the inside front of hook 36 (that is, toward the inside back of hook 36) when slide clip 14 is "clipped" or hooked to, for example, ring 28. The rest of side clip 14 comprises an elongate ring 40 to which hook 36 and retainer 38 are mounted. Elongate ring 40 could be of other configurations, such as square or circular, through which the webbing of the connector body could pass. Elongate ring 40 has an opening 42 through which a portion of connector body 12 passes.

In this version of the invention, connector body 12, prior to construction, is a substantially flat piece or strip of the chosen fabric. The fabric is passed through opening 42, and then is folded evenly over cords 16 which also have been passed through opening 42. As shown, two single cords could be used to provide the means to retain up to four golf club covers. In other variations, cords 16 need not loop through opening 42, but may simply be enclosed or stitched within body 12 so as to pend from one end thereof. Connector body 12 further includes an optional lining 44 which may be stitched inside or enclosed within the exterior of the connector body so as to provide more handleability to the connector. Wear resistance is also enhanced in those areas where there may be friction between side clip 14 and the interior of connector body 12.

Figure 4:
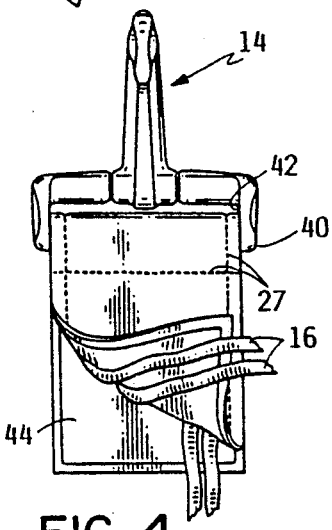
FIG. 4 is a further perspective view of a connector of the present invention showing the interior construction of the connector body.

FIG. 4 is another detailed depiction of the present invention with the opposite corner of connector body 12 being peeled back to show the interior construction. The distal ends of cords 16 have been omitted for illustrative purposes.

The present connector is pocket-sized or hand-sized, compact, and quickly and easily attachable to any of the existing rings or straps traditionally located near the one end of most golf bags. The small size and easy application of the invention enables the golfer to leave it in place on the golf bag, move it to another location on the bag, or to simply detach and reattach at will. For example, a size in the range of approximately 2 inches by 3 inches for the connector body is preferred. The connector can be carried in the golfer's pocket or luggage on a trip, or it can be stored in a golf bag. It is elegantly simple to use and can be used with both tassel-type head covers and covers with rings or loops. In this latter embodiment, the cords would simply be looped through the ring on the golf club head cover and back through the chosen loop securement means.

The present article is said to be "easily detachable". This characterization is intended to mean easily detached from both a golf club bag and a golf club cover. This feature provides ease of utilization and is one of the primary advantages of this invention.

The present invention's functionality, size, simplicity of design, ease of use and portability are so distinct and novel that when compared to the devices of the patents discussed above there is no question that the present invention produces "unusual and surprising" results. The combination of all of the above qualities of the device enable the contention to be made that the previously unsolve problem of securing and safeguarding golf club head covers has been solved with surprising simplicity and ease. The present invention successfully provides previously unappreciated advantages to the general golfing public and the golf industry at large. People simply do not know what to do with their golf club head covers to prevent their loss.

The above disclosure will suggest many alterations and variations to one of ordinary skill in this art. This disclosure is intended to be illustrative and not exhaustive. All such variations and permutations suggested by the above disclosure are to be included within the scope of the attached claims.

What is claimed is as follows:

1. An easily detachable connector for securing golf club head protectors to a golf bag comprising:

a golf bag attachment means;

a connector body, said connector body connected to said golf bag attachment means, a first flexible cord having a first portion and an unsecured distal end, said first flexible cord having a second portion for forming into a loop with itself, said first portion of said first flexible cord secured to said connector body to hold said first flexible cord thereto;

a first cord lock, said first cord lock secureable to said first flexible cord said second portion of said first flexible cord forming a first loop with said first flexible cord, said first loop operable for attaching said first flexible cord to a first golf club protector, said first cord lock movable and secureable along said first flexible cord to enable securing of said first loop to a first golf club protector by compressing the first flexible cord in said first cord lock, the size of said first loop and the position of said first loop along said first flexible cord being adjustable along said first flexible cord by positioning said first cord lock along said first flexible cord;

a second flexible cord having a first portion and an unsecured distal end, said second flexible cord having a second portion for forming into a loop with itself, said first portion of said second flexible cord secured to said connector body to hold said second flexible cord thereto, said second flexible cord secured to said connector body independent of said first flexible cord; and a second cord lock, said second cord lock secureable to said second flexible cord, said second portion of said second flexible cord forming a second loop with itself for attaching said second flexible cord to a second golf club protector, said second cord lock movable and secureable along said second flexible cord to enable securing of said second loop to the second golf club protector by compressing the second flexible cord in said second cord lock, the size of said second loop and the position of said second loop along said second flexible cord being adjustable independent to the position and size of said first loop, said first flexible cord coacting with the first golf club protector and said second flexible cord coacting with the second golf club protector so that said connector prevents either the first golf club protector or the second golf club protector from being accidently lost.

2. A connector according to claim 1 wherein the golf bag attachment means comprises a side release clip.

3. A connector according to claim 2 wherein the distal end of said first flexible cord includes a terminus to assist a user in threading said first flexible cord through said first cord lock.

4. A connector according to claim 3 wherein the connector body comprises a member folded over and stitched to itself to secure said first flexible cord and said second flexible cord in said connector body.

5. A connector according to claim 1 wherein the golf bag attachment means is attached to said connector body.

6. A connector according to claim 1 wherein said connector body is pliable.

7. A connector according to claim 6 wherein said connector body comprises synthetic material.

8. A connector according to claim 6 wherein said connector body comprises natural material.

9. A connector according to claim 1 wherein the connector body is rectangular, having dimensions of about two inches by three inches.

10. A connector for securing golf club head protectors to a golf bag comprising:

a connector body, said connector body having a first end and a second end;

a golf bag attachment means, said golf bag attachment means connected to said connector body to attach said golf bag attachment means to a golf bag;

a first flexible cord secured to said connector body, said first flexible cord having an unsecured distal end and a first portion, said first portion of first flexible cord formable into a first loop;

first loop securement means for securing said first flexible cord to itself to thereby hold said first flexible cord in the first loop, said first loop securement means positionable along said first flexible cord to enable a user to position and secure said first loop to a first golf club head protector to prevent the first golf club head protector from being lost when the first golf club protector is removed from a golf club in the golf bag;

a second flexible cord secured to said connector body said second flexible cord having an unsecured distal end and a first portion, said first portion of said second flexible cord secured to said body independent of said first flexible cord, said second flexible cord formable into a second loop; and second loop securement means for securing said second flexible cord to itself to thereby hold said second flexible cord in the second loop, said second loop securement means positionable along said second flexible cord to enable a user to position and secure said second loop to a second golf club head protector to prevent the second golf club head protector from being lost when the second golf club protector is removed form a golf club in the golf bag.

11. A connector according to claim 10 wherein the loop securement means comprise cord locks.

* * * * *